US008138987B2

(12) United States Patent
Kapuliansky et al.

(10) Patent No.: US 8,138,987 B2
(45) Date of Patent: Mar. 20, 2012

(54) COMPACT MULTIBAND ANTENNA

(75) Inventors: Ephraim Kapuliansky, Nazerath Illit (IL); Matti Martiskainen, Tiberias Illit (IL); Anatoly Berezin, Tiberias (IL); Steve Krupa, Tiberias (IL)

(73) Assignee: Galtronics Corporation Ltd., Tiberias (IL)

( * ) Notice: Subject to any disclaimer, the term of this patent is extended or adjusted under 35 U.S.C. 154(b) by 344 days.

(21) Appl. No.: 12/466,156

(22) Filed: May 14, 2009

(65) Prior Publication Data

US 2010/0013732 A1 Jan. 21, 2010

Related U.S. Application Data

(60) Provisional application No. 61/134,990, filed on Jul. 15, 2008.

(51) Int. Cl.
*H01Q 7/00* (2006.01)

(52) U.S. Cl. ..... 343/866

(58) Field of Classification Search ..... 343/866, 343/702, 725, 867, 700 MS
See application file for complete search history.

(56) References Cited

U.S. PATENT DOCUMENTS

| | | | | |
|---|---|---|---|---|
| 7,843,390 | B2 | 11/2010 | Liu | |
| 2003/0210193 | A1 * | 11/2003 | Rossman et al. | 343/725 |
| 2004/0087341 | A1 | 5/2004 | Edvardsson | |
| 2004/0125020 | A1 * | 7/2004 | Hendler et al. | 343/700 MS |
| 2005/0007293 | A1 * | 1/2005 | Handelsman | 343/867 |

OTHER PUBLICATIONS

An International Preliminary Report on Patentability, dated Jan. 27, 2011, which issued during the prosecution of Applicant's PCT/IL09/000491.

* cited by examiner

*Primary Examiner* — Huedung Mancuso
(74) *Attorney, Agent, or Firm* — Sughrue Mion, PLLC

(57) ABSTRACT

An antenna, including a dielectric carrier having a bounding surface, and a conductive monopole resonant at a first frequency, the monopole having at least one conducting section mounted on the bounding surface. The antenna further includes a labyrinthine conductive coupling element mounted on the bounding surface so as to encompass the dielectric carrier. The coupling element is located with respect to the conductive monopole so as to transfer from the conductive monopole a second frequency lower than the first frequency.

34 Claims, 13 Drawing Sheets

COMPACT MULTIBAND ANTENNA

CROSS-REFERENCE TO RELATED APPLICATION

This application claims the benefit of U.S. Provisional Patent Application 61/134,990, filed Jul. 15, 2008, which is incorporated herein by reference.

FIELD OF THE INVENTION

The present invention relates generally to antennas, and specifically to compact antennas that may be used in multiple bands.

BACKGROUND OF THE INVENTION

There are a number of conflicting demands that have to be balanced in order to efficiently produce communication devices, such as cellular telephones or personal digital assistants (PDAs). Costs have to be minimized, and typically the devices themselves are becoming smaller yet more complex. In addition, devices that relatively recently were only required to operate efficiently on one or two wavelength bands may now be required to operate, with substantially the same efficiency, over five or more bands. A critical component in implementing this efficient operation is a correctly designed antenna that meets all of the conflicting demands of cost, efficient operation over multiple bands, and size, as well as other considerations, such as ease of assembly, that will be familiar to those skilled in the art. While antennas that operate over multiple bands are well known in the art, there is a continuing need for an improved antenna of this type.

SUMMARY OF THE INVENTION

In some embodiments of the present invention, an antenna comprising at least two elements is at least partially formed on the bounding surface of a dielectric carrier.

In one embodiment a first element of the antenna comprises a monopole, at least part of which is located on the bounding surface. The monopole is implemented so as to have one of its end points, herein termed the feed end point, in proximity to a ground connection. Typically, the monopole is in the form of a linear, folded, or meandering conductive strip, arranged to be a quarter wavelength resonator. While the monopole may be configured in two dimensions, or even in one dimension, it is typically configured in three dimensions. The monopole may be a single-band monopole or a multi-band monopole configured to resonate in one or more high frequency bands, for example, bands such as the 1800 MHz, 1900 MHz, and/or 2100 MHz bands or higher bands.

A second element of the antenna comprises a labyrinthine coupling element which is mounted on the bounding surface, in proximity to the monopole. The coupling element may be formed of one conducting section. Alternatively, the coupling element comprises multiple conducting sections galvanically connected together. The coupling element partially envelopes the monopole, is connected to a ground, and acts to couple electric and magnetic fields between the monopole and the ground. The partial envelopment by the coupling element is typically three-dimensional, and allows the antenna to have a small overall volume.

The coupling results in enhanced bandwidth for the antenna, by using radiation properties of the ground, which has a large volume and a correspondingly high bandwidth, instead of radiation properties of the coupling element, which has a relatively small volume and correspondingly small bandwidth.

The coupling element efficiently couples low frequencies, such as those in the 850 MHz and 900 MHz bands, so that they transfer from the monopole to the ground, which radiates them. The amount of coupling may be adjusted, and if it is configured to be high for high frequency bands, the high frequency bands at which the monopole resonates also transfer well to the ground, from where they radiate. The antenna thus acts as an efficient compact radiator of radiation in low and high frequency bands.

In some embodiments an enhanced capacitance is implemented between the coupling element and the monopole. The enhanced capacitance may be formed by one or more lumped elements connecting the coupling element and the monopole, and/or by a distributed arrangement of the coupling element and the monopole. Alternatively or additionally there is another enhanced capacitance formed between the coupling element and the ground. The enhanced capacitances may be selected to facilitate a desired coupling between the monopole and the ground.

In an alternative embodiment of the present invention, the coupling element is configured as a loop.

In a further alternative embodiment of the present invention, the first element is configured as a loop.

An embodiment of the present invention may be used as an antenna in a communication device, where the antenna is coupled to a transceiver operating in the device.

There is therefore provided, according to an embodiment of the present invention, an antenna, including:

a dielectric carrier having a bounding surface;

a conductive monopole resonant at a first frequency, including at least one conducting section mounted on the bounding surface; and a labyrinthine conductive coupling element mounted on the bounding surface so as to encompass the dielectric carrier, the coupling element being located with respect to the conductive monopole so as to transfer from the conductive monopole a second frequency lower than the first frequency.

Typically, the conductive monopole includes a further section mounted within the dielectric carrier, and the coupling element surrounds the further section.

The coupling element may be resonant at the second frequency.

In one embodiment the antenna includes a ground which is located in proximity to the coupling element so as to receive the second frequency transferred from the coupling element. Typically, there is an impedance coupled between the coupling element and the ground so as to enhance transfer of at least one of the first frequency and the second frequency.

In some embodiments, the first frequency includes a plurality of frequency bands, and the conductive monopole includes a multi-band monopole configured as a series circuit resonant at the plurality of frequency bands. The plurality of frequency bands may include frequencies between 1700 MHz and 5.6 GHz.

In some embodiments, the second frequency includes a plurality of frequency bands, and the coupling element is configured as a series circuit resonant at the plurality of frequency bands. The plurality of frequency bands may include frequencies between 700 MHz and 1000 MHz. The first frequency may include a multiplicity of frequency bands, and the coupling element may be configured as a parallel circuit resonant at the multiplicity of frequency bands. The multiplicity of frequency bands may include frequencies between 1700 MHz and 5.6 GHz.

In an alternative embodiment, the antenna includes a capacitance coupled between the coupling element and the monopole so as to enhance the transfer of the second frequency.

In another alternative embodiment, the dielectric carrier includes a dielectric element connected to a dielectric substrate of a printed circuit board (PCB) at a common surface thereof, and a further section of the conductive monopole may be mounted on the common surface.

In a yet other alternative embodiment, the dielectric carrier includes a dielectric element connected to a dielectric substrate of a printed circuit board (PCB), and the at least one conducting section and the PCB have a common edge.

Typically, the conductive monopole includes at least one of a linear conductive strip, an L-shaped conductive strip. a folded conductive strip, a meandering conductive strip, and an at least partially looped conductive strip.

In a disclosed embodiment, the antenna includes a ground plane galvanically connected to the coupling element so that a combination of the ground plane and the coupling element form a closed loop.

In another disclosed embodiment, the conductive coupling element includes at least one slot, and a perimeter of the at least one slot may be configured in response to a desired resonant frequency of the conductive element.

There is further provided, according to an embodiment of the present invention, an antenna, including:

a dielectric substrate;

a full-wave loop mounted on the substrate, the full-wave loop being resonant at a first frequency;

a ground plane mounted in proximity to the full-wave loop; and a conductive coupling element galvanically connected to the ground plane so as to form a closed loop completely surrounding the full-wave loop, the conductive coupling element being resonant at a second frequency lower than the first frequency.

Typically, the conductive coupling element transfers the second frequency from the full-wave loop to the ground plane.

In one embodiment a portion of the conductive coupling element is configured to form a capacitor, with the ground plane, that augments transfer of the first frequency from the full-wave loop to the ground plane. The capacitor is typically external to the closed loop.

In a disclosed embodiment the full-wave loop and the closed loop are mounted on a common plane of the substrate, and the closed loop completely surrounds the full-wave loop as measured in the common plane.

There is further provided, according to an embodiment of the present invention, an antenna, including:

a dielectric substrate;

a monopole mounted on the substrate, the monopole being resonant at a first frequency;

a ground plane mounted in proximity to the monopole; and a conductive coupling element galvanically connected to the ground plane so as to form a closed loop completely surrounding the monopole, the conductive coupling element being resonant at a second frequency lower than the first frequency.

Typically, the conductive coupling element transfers the second frequency from the monopole to the ground plane.

In one embodiment a portion of the conductive coupling element is configured to form a capacitor, with the ground plane, that augments transfer of the first frequency from the monopole to the ground plane. The capacitor may be external to the closed loop.

In a disclosed embodiment the monopole and the closed loop are mounted on a common plane of the substrate, and the closed loop completely surrounds the monopole as measured in the common plane.

There is further provided, according to an embodiment of the present invention, a method of forming an antenna, including:

providing a dielectric carrier having a bounding surface;

mounting at least one conducting section of a conductive monopole resonant at a first frequency on the bounding surface; and mounting a labyrinthine conductive coupling element on the bounding surface so as to encompass the dielectric carrier, the coupling element being located with respect to the conductive monopole so as to transfer from the conductive monopole a second frequency lower than the first frequency.

There is further provided, according to an embodiment of the present invention, a method for forming an antenna, including:

providing a dielectric substrate;

mounting a full-wave loop on the substrate, the full-wave loop being resonant at a first frequency;

positioning a ground plane in proximity to the full-wave loop; and galvanically connecting a conductive coupling element to the ground plane so as to form a closed loop completely surrounding the full-wave loop, the conductive coupling element being resonant at a second frequency lower than the first frequency.

There is further provided, according to an embodiment of the present invention, a method for forming an antenna, including:

providing a dielectric substrate;

mounting a monopole on the substrate, the monopole being resonant at a first frequency;

locating a ground plane in proximity to the monopole; and galvanically connecting a conductive coupling element to the ground plane so as to form a closed loop completely surrounding the monopole, the conductive coupling element being resonant at a second frequency lower than the first frequency.

There is further provided, according to an embodiment of the present invention a communication device, including:

a transceiver; and one of the antennas described herein.

The present invention will be more fully understood from the following detailed description of the embodiments thereof, taken together with the drawings in which:

DETAILED DESCRIPTION OF EMBODIMENTS

Overview

Antennas described herein comprise a high frequency resonator, and a coupling element, placed in proximity to, but insulated from, the resonator. The coupling element couples electric and magnetic fields between the resonator and a ground. The coupling element may be conveniently mounted or formed on the surface of a dielectric carrier, and at least a portion of the high frequency resonator may also be on the surface.

The antennas have a feed region consisting of an end of the resonator and a section of the ground. If the feed region is fed by high and low frequencies, the coupling element couples and transfers the low frequencies to the ground, from where they radiate. If the coupling is relatively high for higher frequencies, the high frequencies also transfer and radiate from the ground, and the bandwidth of the antennas is broad. The antennas may thus be configured as good wide bandwidth radiators for low and high frequencies.

In one embodiment the high frequency resonator is a quarter-wave monopole, the high frequencies usually ranging from approximately 1.7 GHz to approximately 2.6 GHz or higher. Typically, the monopole is in the form of an inverted-L, but may comprise other configurations, such as having one or more branches, and/or being a partial loop. The monopole typically acts as a series resonant circuit resonating at the high frequencies, and not resonating at the low frequencies.

The ground typically acts as a parallel resonant circuit for the low frequencies, which may range down to approximately 700 MHz. The coupling element typically acts as a series resonant circuit for the same low frequencies as the ground, as well as acting as a parallel resonant circuit at the high frequencies.

The coupling element may include one or more slots resonating at selected frequencies, so as to increase bandwidth, and/or so as to provide one or more additional bands.

The coupling element typically encompasses or encloses the dielectric carrier, so as to fold about or partially surround the monopole. The folding of the coupling element ensures that embodiments of the present invention are compact.

In other embodiments, one or both of the high frequency resonator and the coupling element are loops.

The antennas described herein may be fed by any means suitable for transferring radio-frequency currents. Typically, although not necessarily, the antennas may be fed by a guided transmission line such as a flexible or rigid coaxial cable.

Description of Embodiments

Figure 1A:
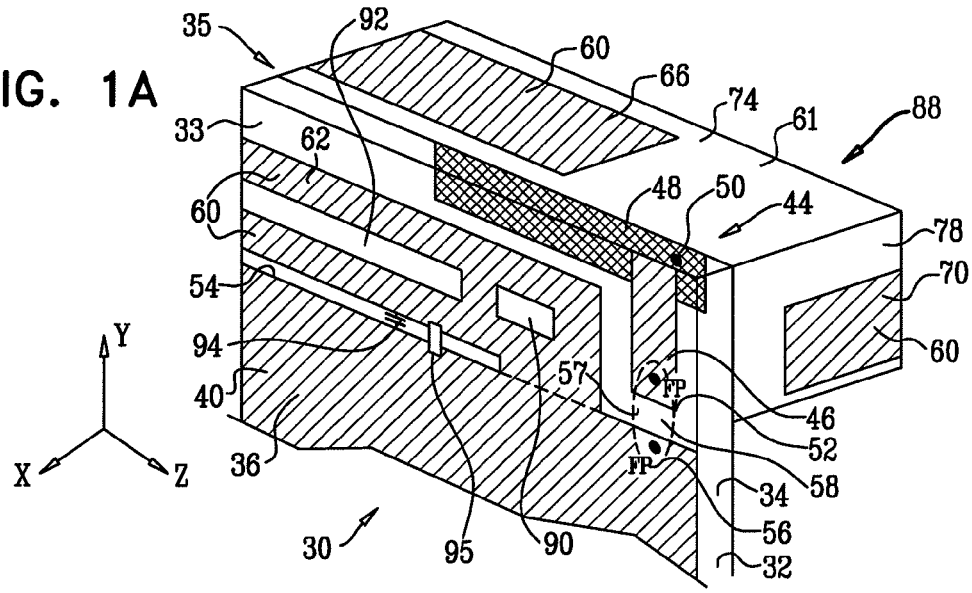
FIGS. 1A, 1B, and 1C are schematic views of an antenna, according to an embodiment of the present invention.
Figure 1B:
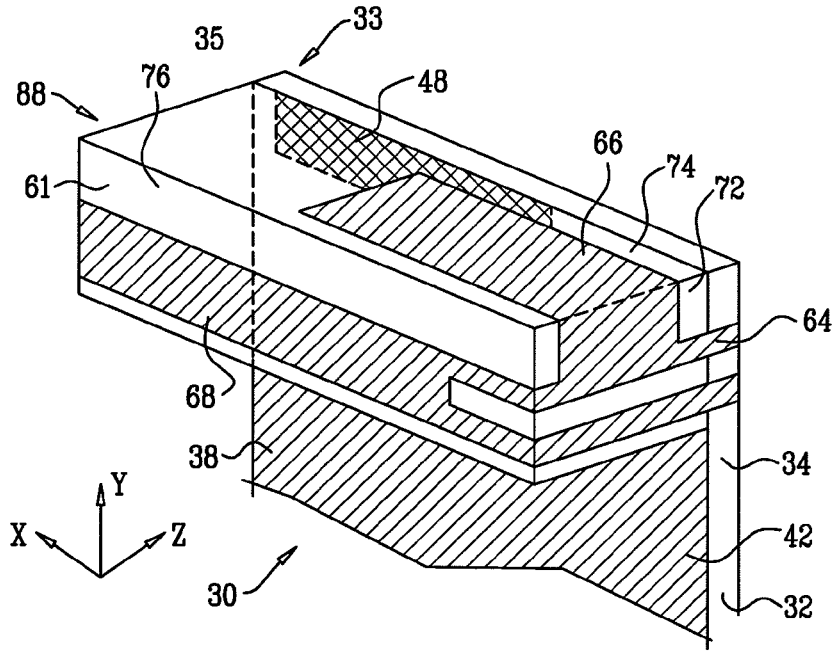
Figure 1C:
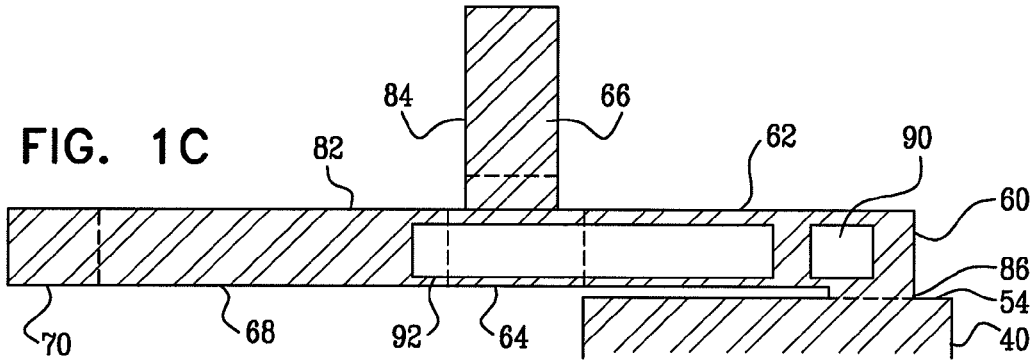

Reference is now made to FIGS. 1A, 1B, and 1C, which are schematic perspective views of an antenna 30 and a schematic planar view of an element of the antenna, according to an embodiment of the present invention. In the following description, it is assumed, by way of example, that FIG. 1A represents a front view of antenna 30, and that FIG. 1B represents a rear view of the antenna. It is also assumed, by way of example, that antenna 30 is at least partially formed on one or more dielectric surfaces of a printed circuit board (PCB) 32 having approximate dimensions 55 mm wide×120 mm long×1 mm thick. For clarity, in the following description, PCB 32 is assumed to be aligned with orthogonal xyz axes, and dimensions of antenna 30 are given using these axes. However, it will be understood that antenna 30 is operative in any convenient orientation.

In the following description PCB 32 is assumed to have two conducting layers on respective surfaces of a dielectric separating the layers. However, in practice the PCB may have any other convenient number of conducting layers separated by dielectrics. The surfaces of the PCB, and the conducting layers, may be plane or curved. Furthermore, there is no requirement that embodiments of the present invention be at least partially formed on a PCB. Rather, conducting elements of antennas formed as embodiments of the present invention may be formed in contact with any convenient dielectric, including both solid and gaseous dielectrics. Thus, at least some portions of conducting elements of antennas formed as embodiments of the present invention may be substantially completely surrounded by the dielectric air.

As is described in more detail below, antenna 30 has a small volume, but is able to operate efficiently over a wide range of radio-frequency (RF) values, from approximately 700 MHz to approximately 2200 MHz and higher frequencies. Furthermore, the inventors have found that the height of PCB 32, in the y-direction, required for components of antenna 30, need be no more than about 12 mm, even for the low operating frequency of approximately 700 MHz, with the remainder of the PCB being available for use as a ground plane and/or for mounting circuitry coupled to the antenna. Typically, if more height is available, antenna 30 may be configured to operate efficiently over a wider range of frequencies than those given above.

PCB 32 comprises a dielectric 34, which is initially overlaid, on a front surface 33 of the dielectric, with a front conducting layer 36, and on a rear surface 35 of the dielectric with a rear conducting layer 38. Dielectric 34 is also herein termed PCB-dielectric 34. Antenna 30 may be formed at least partially on PCB-dielectric 34 by removing portions of the conducting layers. In addition to forming elements of antenna 30, the remaining portions of the conducting layers form a front ground plane 40 and a rear ground plane 42. The ground planes are typically connected galvanically, for instance by vias, and may be used by antenna 30 as a ground for the antenna. However, there is no necessity for the ground of antenna 30 to be provided by the ground planes, and the ground of the antenna may be wholly or partially provided by other conducting elements, such as circuitry and/or a housing wherein the circuitry is operative.

Antenna 30 comprises a monopole 44. Monopole 44 is formed as a first conducting section 46, parallel to the y-axis, and a second conducting section 48, parallel to the x-axis. The two sections 46, 48, are approximately rectangular, having respective approximate dimensions 3 mm×10 mm and 34 mm×3 mm. The two sections are galvanically connected by a via 50. Section 46 is produced on front surface 33 by removing a portion of front conducting layer 36; section 48 is produced on rear surface 35 by removing a portion of rear conducting layer 38. The sections are arranged so that monopole 44 is in the form of an inverted-L having an effective length of approximately 40 mm with a feed point 52, herein termed a live feed point, at a lower part of section 46.

Front ground plane 40 has a discontinuous edge 54, parallel to the x-axis. An insulating gap 57 of approximately 2 mm is formed between edge 54 and a lower edge of section 46. An area 56 of ground plane 40, near edge 54 and section 46, is used as another feed point, herein termed a ground connection. Thus, monopole 44 has a feed region 58 formed of live feed point 52 and area 56. For the length of monopole 44 given above, the monopole, when fed via feed region 58, acts as a quarter-wave series resonant circuit having a resonant frequency in the 1800 MHz (1710-1880 MHz) band. In some embodiments monopole 44 may be implemented as a multi-band monopole, in one or more other bands, such as the 2100 MHz (1920-2170 MHz) band. Those having ordinary skill in the antenna art will be aware of methods for implementing monopole 44 as a multi-band monopole.

In addition to monopole 44, antenna 30 comprises a labyrinthine ground coupling element 60 made of a number of galvanically connected portions. As described in more detail below, the coupling element acts as a series resonant circuit for low frequencies, and as a parallel resonant circuit for high frequencies. FIG. 1C is a schematic illustration of element 60 in a plan form. One portion 62 of coupling element 60 is formed to be continuous with edge 54 of front ground plane 40, and to lie on front surface 33 of the PCB-dielectric. Other portions 64, 66, 68, and 70 of the coupling element are formed to be on respective surfaces 72, 74, 76, and 78 of a box-shaped dielectric element 61. A part of portion 64 is also formed to be over an edge of PCB-dielectric 34. Dielectric element 61 has approximate dimensions 55 mm×12 mm×10 mm. Element 61 is connected to surface 35 of the PCB-dielectric, typically by cementing, after removal of a corresponding region of rear layer 38, so that the element and the PCB-dielectric have a common surface. Alternatively, some of rear layer 38 may not be removed, and the part not removed may be used to provide capacitance with monopole 44. Element 61 is aligned so as to be approximately flush with the upper and side edges of the PCB-dielectric.

As is illustrated in FIG. 1C, coupling element 60 may be considered to be formed as an elongated rectangle 82, having approximate dimensions 110 mm×6 mm. A second rectangle 84, comprising portion 66 and a part of portion 64, is connected to the elongated rectangle and has approximate dimensions 25 mm×6 mm. A third region 86 connects the elongated rectangle to front ground plane 40.

As is illustrated in FIGS. 1A and 1B, coupling element 60 encompasses or surrounds a combination dielectric carrier 88 that consists of element 61 and the portion of PCB-dielectric to which the carrier is connected. The coupling element is mounted on a bounding surface of the dielectric carrier, the bounding surface comprising surfaces 72, 74, 76, and 78 of the carrier, corresponding edges of PCB 32, as well as a portion of surface 33.

By way of example, carrier 88 is assumed to be in the form of a rectangular parallelepiped, although it will be understood that the carrier may be any convenient three-dimensional solid. As is illustrated in FIGS. 1A and 1B, the encompassment of dielectric carrier 88 by coupling element 60 typically occurs in three dimensions, so that in antenna 30 five sides of carrier 88 have parts of coupling element 60 mounted thereon. In other embodiments, the encompassment is accomplished by having parts of coupling element 60 mounted on at least two sides of carrier 88. As is also illustrated in FIGS. 1A and 1B, coupling element 60 effectively surrounds conductive section 48 of monopole 44.

Coupling element 60 comprises one or more slots formed within the element. The slots may be completely closed within the coupling element, or partially closed within the element so as to effectively form an indentation within an edge of the element. By way of example, in the description herein the element is assumed to have two rectangular slots formed within rectangle 82. A first slot 90 has approximate dimensions 5 mm×3 mm; a second slot 92 has approximate dimensions 55 mm×3 mm. The slots are located approximately on a center line of rectangle 82, near region 86, and are separated by a conducting region of element 60 having a width of approximately 3 mm. Changing the sizing and location of the slots enables the frequencies at which coupling element 60 resonates to be varied.

A coupling capacitor 94 may be connected between a lower edge of portion 62 and edge 54 of ground plane 40. Alternatively or additionally, a capacitance approximately equivalent to that of capacitor 94 may be implemented by forming a portion of the lower edge of coupling element 60 to be closer to edge 54 than the remainder of the lower edge. Typically, the portion may be separated from edge 54 by a gap of the order of 0.1 mm. The capacitance of lumped element 94 and/or of the portion generated by the lower edge of coupling element 60 provide an enhanced capacitance between the coupling element and ground plane 40. In one embodiment capacitor 94 has a capacitance of approximately 2.2 pF.

If high frequencies, such as frequencies at which monopole 44 is resonant, are fed to region 57, coupling element 60 transfers these frequencies to the ground or ground plane 40, from where they radiate. The coupling and transfer of the high frequencies may be improved by varying the value and position of coupling capacitor 94, and/or of the alternative capacitance described above. Such variation, to achieve a desired enhancement, may be performed by one having ordinary skill in the art without undue experimentation.

If low frequencies, below approximately 1000 MHz, are fed to region 57, coupling element 60 couples and transfers the low frequencies from monopole 44 to an adjacent ground, and/or to ground plane 40. The coupling of the low frequencies is typically improved to a lesser extent than for the high frequencies by capacitor 94 or the enhanced capacitance described above. The adjacent ground, or ground plane 40, acts as a parallel resonant circuit for lower frequencies, resonating at approximately the same low frequencies as the resonant frequencies of coupling element 60. Thus, the ground or ground plane radiates these low frequencies.

In some embodiments a coupling inductor 95, typically having a value of approximately 20 nH may be connected between a lower edge of portion 62 and edge 54 of ground plane 40. Using inductor 95 may enhance the coupling of the low frequencies, and the value and position of the inductor for a desired enhancement may be determined without undue experimentation.

The inventors have found that antenna 30, formed as described above, operates well as a penta-band antenna in the bands: 850 MHz (824-894 MHz), 900 MHz (880-960 MHz), 1800 MHz (1710-1880 MHz), 1900 MHz (1850-1990 MHz), and 2100 MHz (1920-2170 MHz), as well as operating well down to approximately 700 MHz. The dimensions and parameters of the elements of antenna 30 may be varied, without undue experimentation, to form antennas that radiate well at these and other frequency bands. Such dimensions and parameters include the number, size, shape, and position of conductive elements of the monopole and/or of the coupling element, as well as the position and/or value of the coupling capacitor and/or coupling inductor. For example, the inventors have found that a multi-band antenna, constructed according to the principles described herein for implementing antenna 30, operates well at approximately 2.4 GHz and up to approximately 5.6 GHz.

Figure 2A:
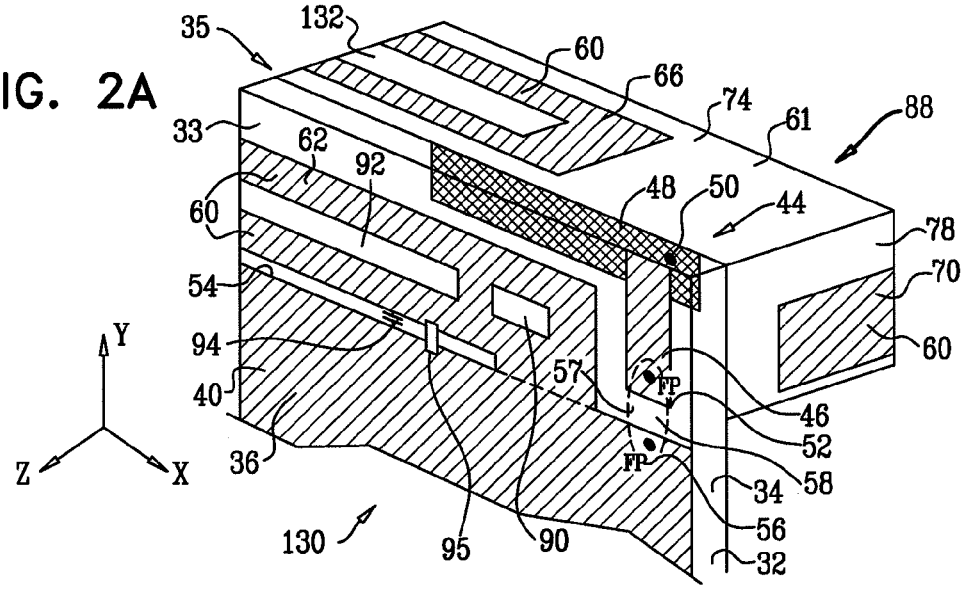
FIGS. 2A, 2B, and 2C are schematic views of an alternative antenna, according to an embodiment of the present invention.
Figure 2B:
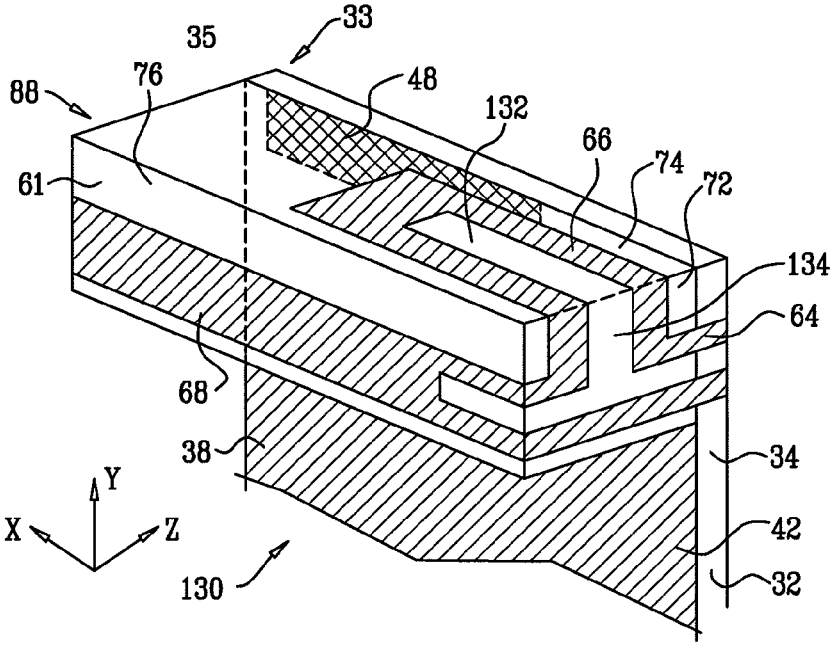
Figure 2C:
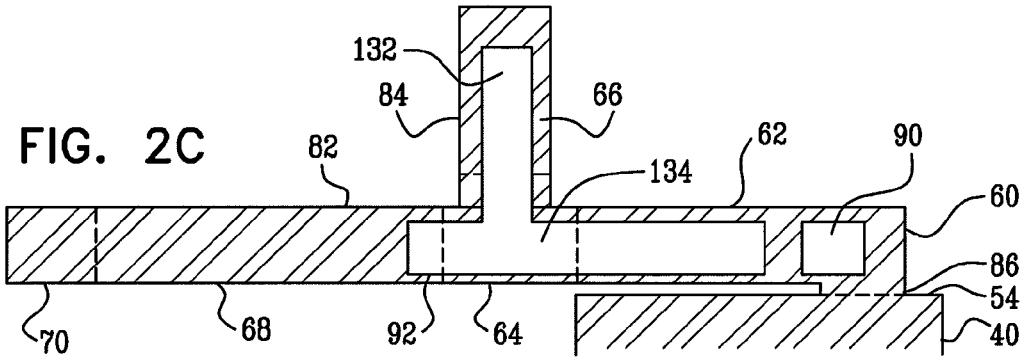

FIGS. 2A, 2B, and 2C, are schematic perspective views of an antenna 130 and a schematic planar view of an element of the antenna, according to an embodiment of the present invention. Apart from the differences described below, the operation of antenna 130 is generally similar to that of antenna 30 (FIGS. 1A, 1B, and 1C), and elements indicated by the same reference numerals in both antennas 30 and 130 are generally similar in construction and in operation.

In antenna 30, slot 92 is, by way of example, rectangular. In antenna 130 slot 92 is altered by removing a conducting rectangular section 132 from portions 64 and 66 of coupling element 60, so as to form a slot 134 having a complex shape. The perimeter of slot 134 is significantly larger than that of slot 92, so that the path taken by RF currents around slot 134 is correspondingly larger than that of slot 92. Configuring the perimeter in this manner, so as to increase the path, is a simple and effective way to effect changes in resonant frequencies of coupling element 60.

Figure 3B:
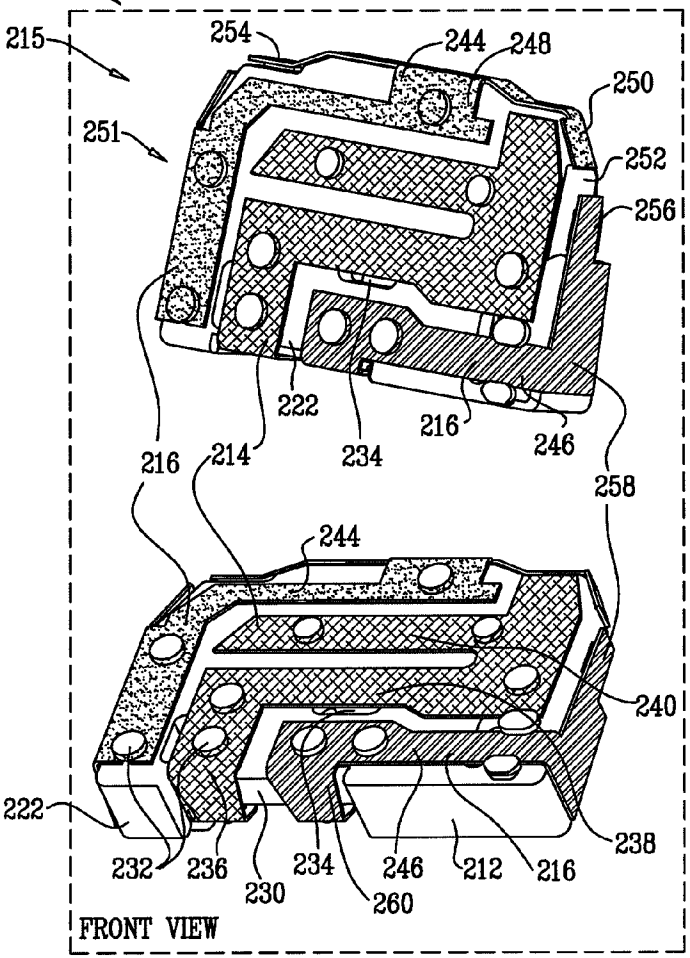
FIGS. 3A, 3B, and 3C show schematic perspective views of another alternative antenna, according to an embodiment of the present invention.
Figure 3A:
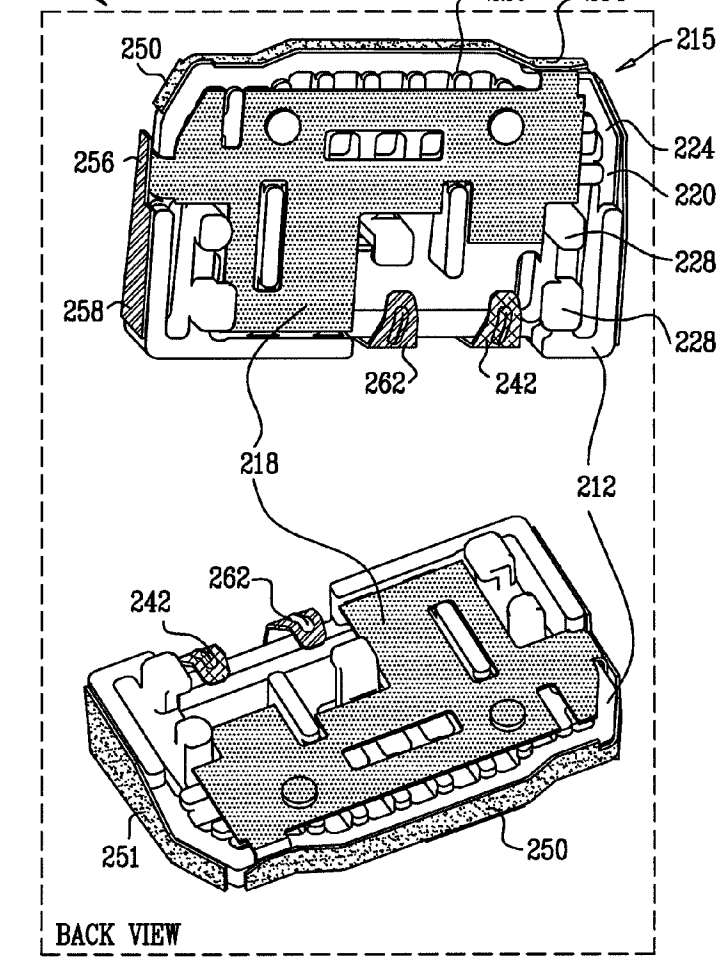
Figure 3C:
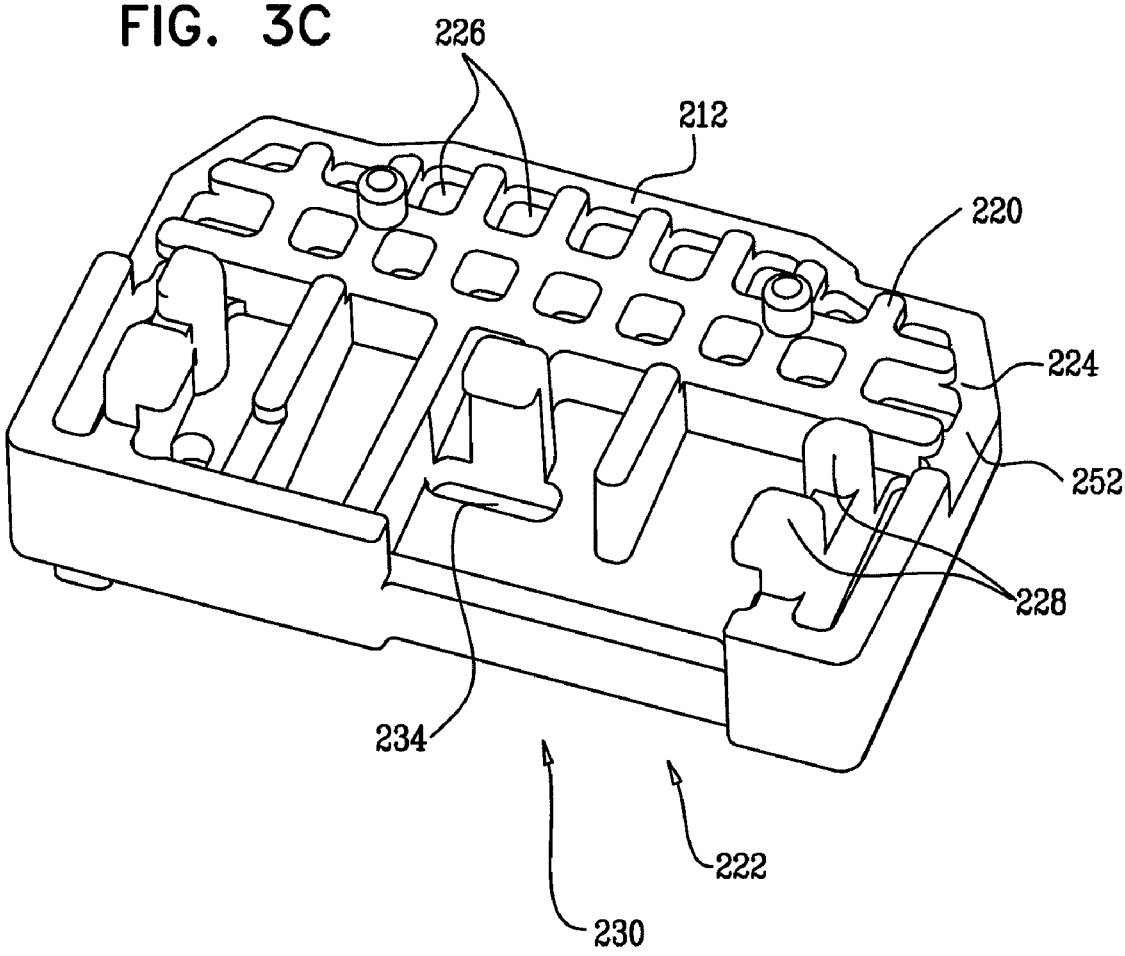
Figure 4C:
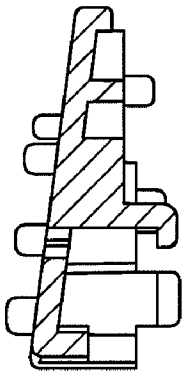
FIGS. 4A-4D, 5A-5E, 6A-6D, 7A-7D, and 8A-8D are schematic engineering views of parts of the alternative antenna of FIGS. 3A, 3B, and 3C, according to an embodiment of the present invention
Figure 4B:
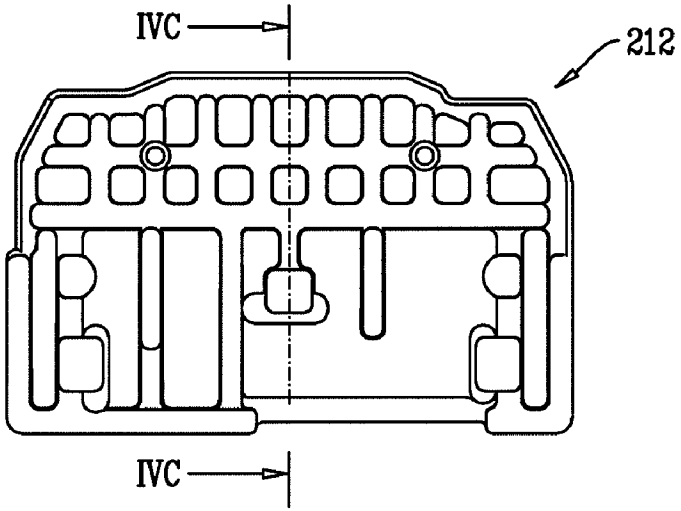
Figure 4A:
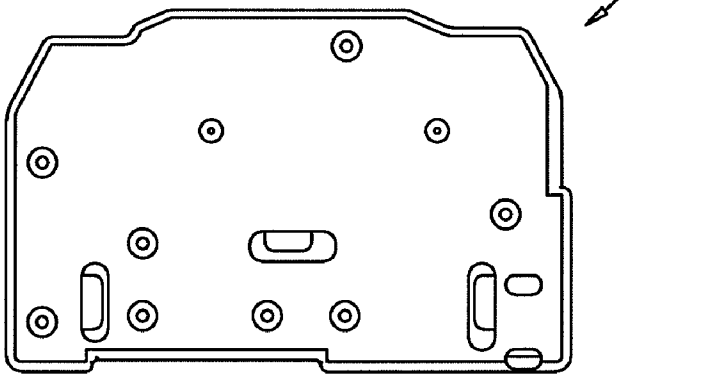
Figure 4D:
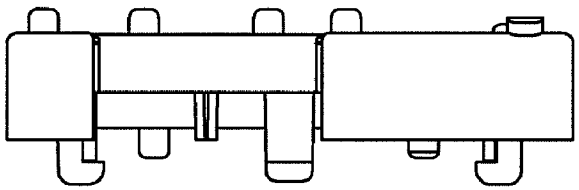
Figure 5A:
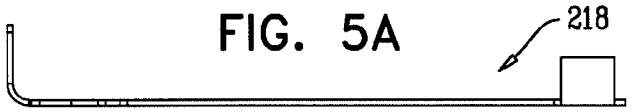
Figure 5B:
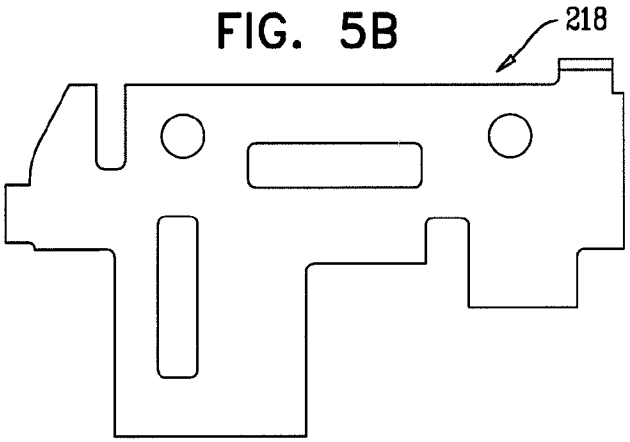
Figure 5C:
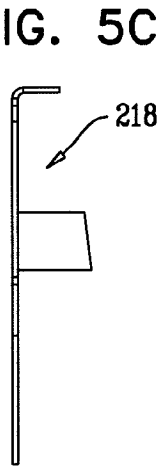
Figure 5D:
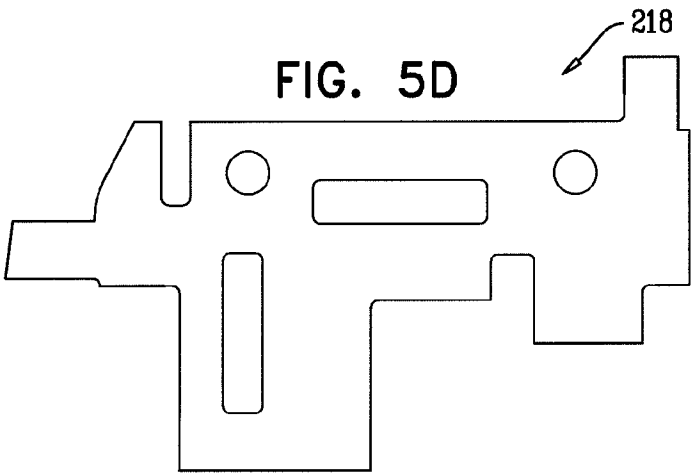
Figure 5E:
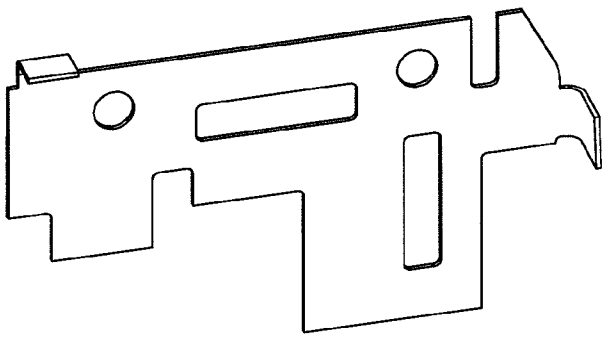
Figure 6A:
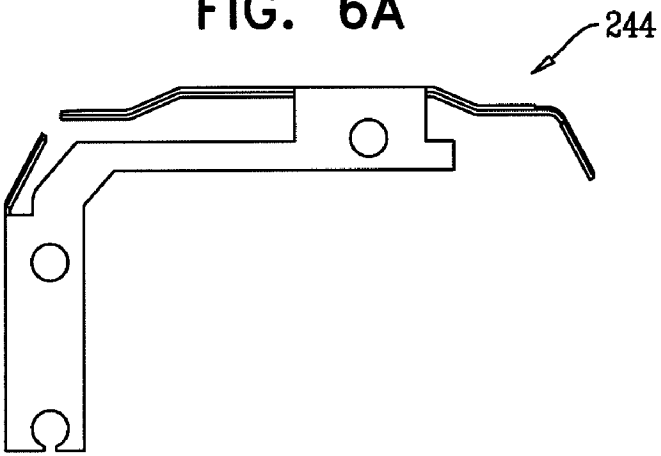
Figure 6B:
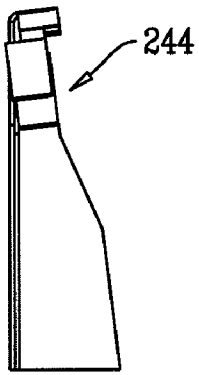
Figure 6C:
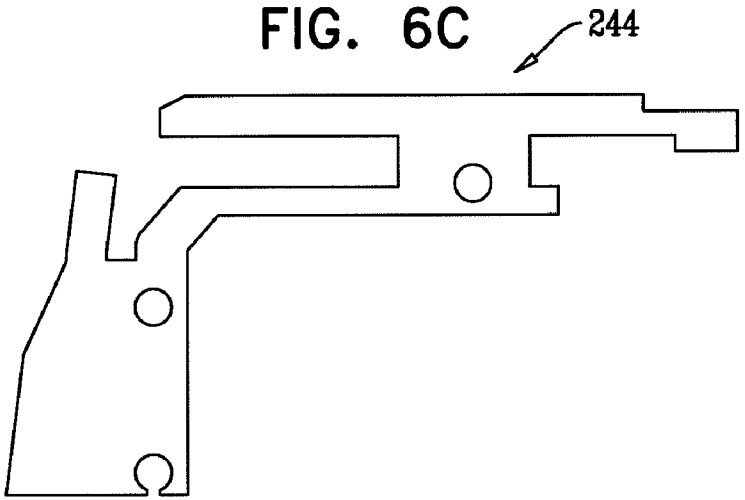
Figure 6D:
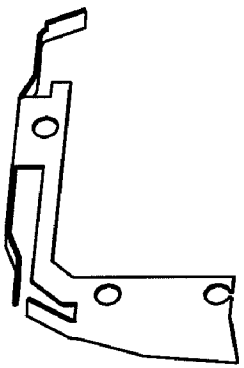
Figure 7B:
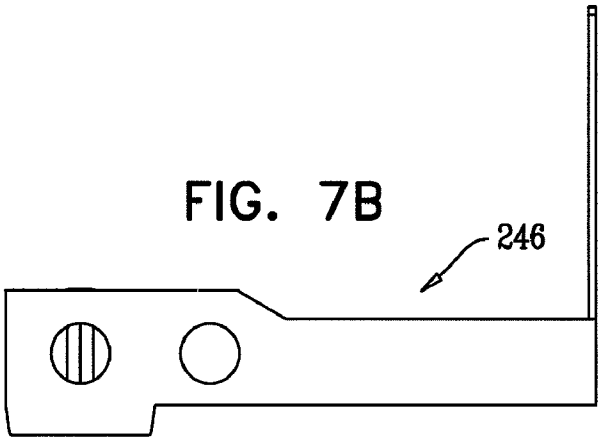
Figure 7D:
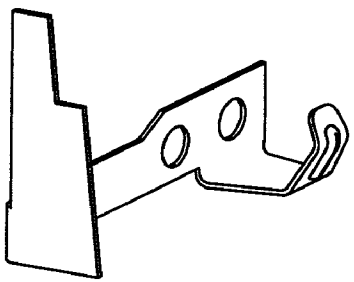
Figure 7A:
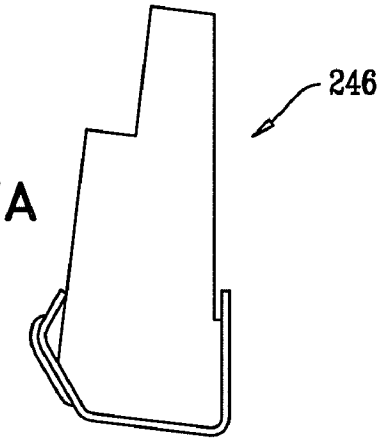
Figure 7C:
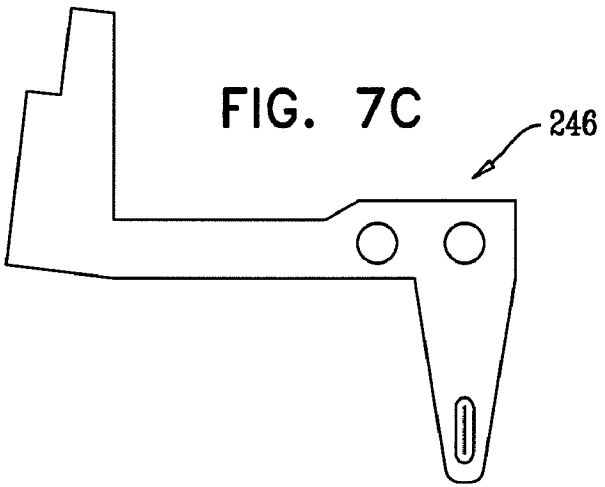
Figure 8A:
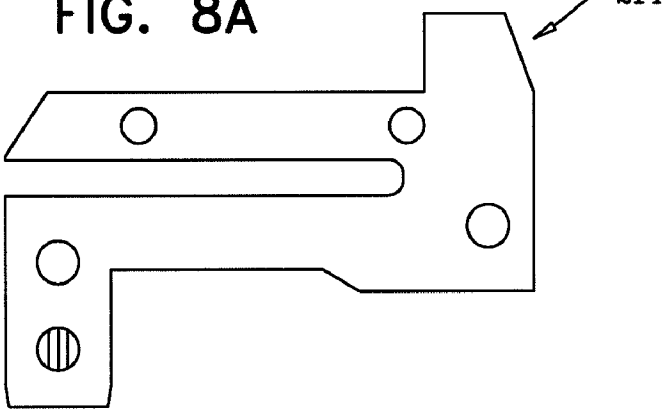
Figure 8B:
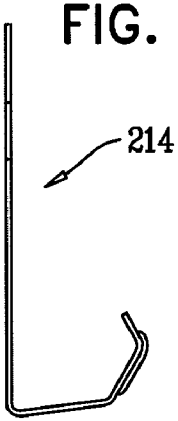
Figure 8C:
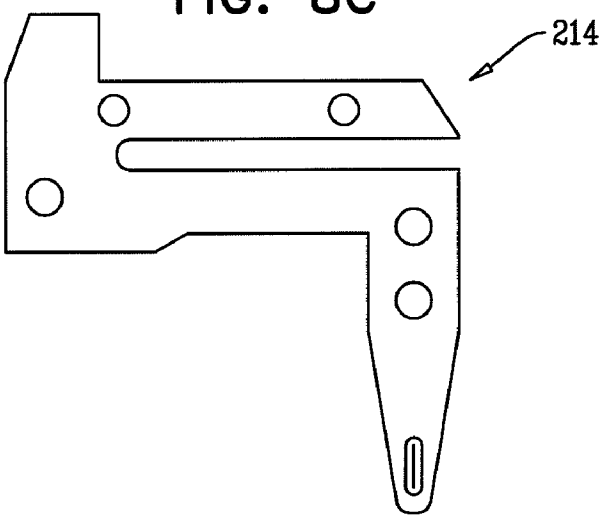
Figure 8D:
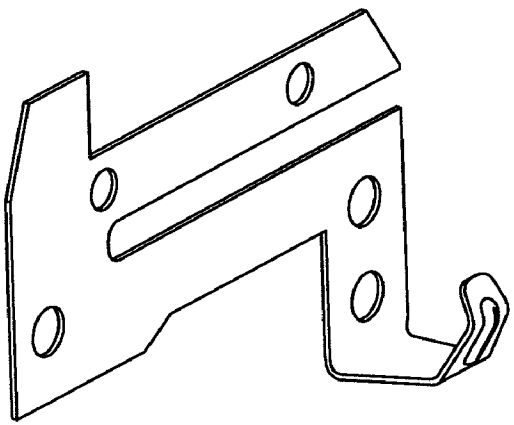

FIGS. 3A, 3B, and 3C show schematic perspective views of an antenna 210 and of one of its parts, and FIGS. 4A-4D, 5A-5E, 6A-6D, 7A-7D, and 8A-8D are schematic engineering views of parts of antenna 210, according to an embodiment of the present invention. In the exemplary embodiment described herein, antenna 210 has approximate external dimensions of 19 mm×12 mm×3.2 mm, so having a volume significantly less than 1 $cm^3$. Antenna 210 typically operates efficiently at radio-frequencies in the bands: 850 MHz (824-894 MHz), 900 MHz (880-960 MHz), 1800 MHz (1710-1880 MHz), 1900 MHz (1850-1990 MHz) and 2100 MHz (1920-2170 MHz) bands. However, by relatively minor adjustments of the dimensions of the parts, antennas substantially similar to antenna 210 may be configured to operate efficiently in other RF bands. Such adjustments may be made without undue experimentation by a person having ordinary skill in the antenna arts.

Antenna 210 is formed from three parts: a dielectric carrier 212, also referred to herein as dielectric holder 212, a conductive radiator 214, and a conductive ground coupling element 215 which is formed of a first section 216 and a second section 218. Antenna 210 is generally similar to antenna 30, so that holder 212, radiator 214, and coupling element 215 of antenna 210 respectively correspond in function and operation to carrier 88, monopole 44, and coupling element 60 of antenna 30. First section 216 is in two parts, described further below, and the two parts are shown in FIGS. 6A-6D and FIGS. 7A-7D. Second section 218 is shown in FIGS. 5A-5E. Holder 212 is shown without the other antenna parts in FIG. 3C and in FIGS. 4A-4D, and has a first side 220 and a second side 222 opposite the first side. FIG. 3A shows first side 220 in the "back views" of the antenna, and FIG. 3B shows second side 222 in the "front views." FIGS. 4A, 4B, 4C, and 4D respectively illustrate a front view, a rear view, a section, and a top view of holder 212.

Each side of holder 212 comprises a planar surface, which typically has one or more gaps and/or one or more protuberances. Thus first side 220 has a planar surface 224, with gaps 226 from indentations into the surface, and protuberances 228 above the surface. Second side 222 has a planar surface 230, also shown in FIG. 3A, with protuberances 232 and a gap 234. Holder 212 is typically formed from rigid plastic such as polycarbonate, with a dielectric constant of the order of 3.

FIGS. 8A, 8B, 8C, and 8D are respective front, side, plan, and perspective views illustrating conductive radiator 214. Radiator 214 is typically formed by bending one piece of planar sheet metal (FIG. 8C), to form a mainly planar radiating element, and is herein also termed planar conductive radiator 214. Planar conductive radiator 214 is positioned to mate with second side 222, so that a surface of the radiator contacts surface 230. Radiator 214 has holes which match some of protuberances 232 of side 222, and these protuberances and mating holes are configured to maintain radiator 214 substantially fixed with respect to holder 212 when the radiator is pushed onto the protuberances. Typically, the protuberances and mating holes maintain the underlying surface of the radiator in contact with surface 230.

In the exemplary embodiment shown in FIGS. 3A, 3B, and 3C, radiator 214 is in the form of an inverted-L monopole with a first feedline section 236 connected to an arm 238 of the L, the arm in turn being galvanically connected to an element 240 parallel to the arm, so that radiator 214 has an extended length formed by folding arm 238 with element 240. As is illustrated, first feedline section 236 may be connected to a "live" feed point 242, formed by bending a portion of radiator 214 round an edge 252 of holder 212, to be above side 220.

Section 216 of ground coupling element 215 is formed of two parts, a first part 244 and a second part 246. FIGS. 6A, 6B, 6C, and 6D are respective front, side, plan, and perspective views illustrating first part 244; FIGS. 7A, 7B, 7C, and 7D are respective front, side, plan, and perspective views illustrating second part 246. Each of the two parts is typically formed by bending one piece of sheet metal (FIG. 6C, FIG. 7C), to form mainly planar ground elements, and section 216 is also referred to herein as planar section 216. Both parts are configured to mate with second side 222, typically in generally the same manner as is described above for the mating of radiator 214 with side 222, so that respective surfaces of the parts contact surface 230. At least one of parts 244 and 246 fold around, i.e., at least partly surround, radiator 214.

As is shown in FIGS. 3A and 3B, ground coupling element 215 is a labyrinthine component having a number of sections that are galvanically connected. First part 244 has a top portion 248 that connects to a first conductive edge element 250. First part 244 also connects to a second conductive edge element 251. First conductive edge element 250 is positioned on edge 252 of holder 212, and the element connects to section 218 at a contact 254. Section 218 of the coupling element connects to part 246 at a contact 256 via a third conductive edge element 258. Third conductive element 258 is located on edge 252, and is connected by an approximately right-angle bend to second part 246. Thus, ground coupling element 215 encloses holder 212, at both sides of the holder and also on the edge of the holder.

A second feedline section 260, of ground coupling element 215, may be connected to a ground feed point 262. Section 260 and feed point 262 may be formed by bending a portion of second part 246 around edge 252 to be above side 220.

Consideration of FIGS. 3A, 3B and 3C shows that antenna 210 has the following properties:

At least one of parts 244 and 246 folds around radiator 214;

Ground coupling element 215 encloses dielectric holder 212, by having sections on both sides of the holder and also at the edge of the holder;

An orthogonal projection of radiator 214 onto side 20 overlaps a portion of section 218 of ground coupling element 215. Typically, the overlap is large, so that taken together with the small distance between the radiator and the section, there is strong capacitive coupling between radiator 214 and section 218.

In operation, radiator 214 typically acts as a series resonant circuit, having high resonant frequencies, such as in the 1800 MHz, 1900 MHz and 2100 MHz bands stated above. Radiator 214, which may be considered as a quarter-wave monopole, also acts to efficiently couple low frequencies, such as those in the 850 MHz and 900 MHz bands, to ground coupling element 215. The coupling is substantially capacitive. Element 215 typically acts as a series circuit resonant at the low frequencies, so as to couple lower frequency bands to a conductor, allowing efficient radiation from a conductor connected to the element. Element 215 typically also acts as a parallel resonant circuit at the high frequency bands. The conductor may be a chassis acting as a ground, or, as exemplified in the antenna described below with reference to FIG. 9, a conductive ground plane which typically acts as a parallel circuit resonant at approximately the same frequencies as the low series resonant frequencies of the coupling element.

The dimensions of antenna 210 may be altered, and typically reduced, by selecting the material from which holder 212 is formed to have a different dielectric constant, as will be apparent to those having ordinary skill in the art. Dimensions of radiator 214 and element 215, as well as of holder 212, may be adjusted by one of ordinary skill in the art, without undue experimentation, in order to optimize the efficiency of the performance of antenna 210, and such adjustments may also be made for frequencies in RF bands other than those stated above.

Figure 9:
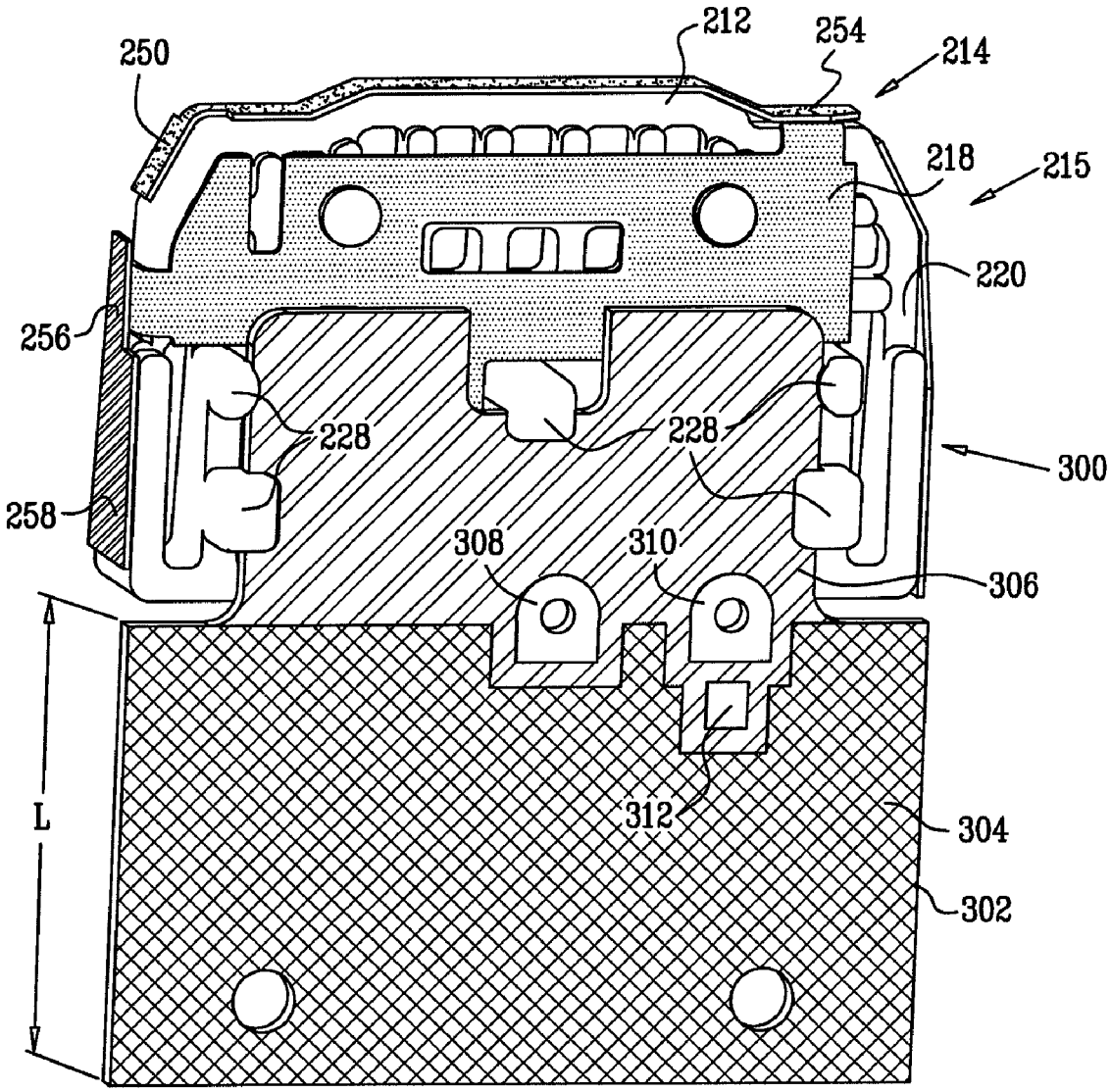
FIG. 9 shows a schematic perspective view of a further alternative antenna, according to an embodiment of the present invention.

FIG. 9 shows a schematic perspective view of an antenna 300, according to an alternative embodiment of the present invention. Apart from the differences described below, the operation of antenna 300 is generally similar to that of antenna 210 (FIGS. 3A, 3B and 3C), and elements indicated by the same reference numerals in both antennas 210 and 300 are generally similar in construction and in operation.

In antenna 300 the three components: dielectric holder 212, planar conductive radiator 214, and conductive ground coupling element 215 are coupled to a printed circuit board (PCB) 302. PCB 302 has a conductive ground plane 304, and a non-conductive section 306. Section 306 is configured to be gripped by some of protuberances 228, so that a lower surface of the section fixedly mates with an upper surface of second planar section 218, and so that the protuberances act as anchors for the PCB.

PCB 302 comprises a ground feed-through 308, and a "live" feed-through 310, the feed-throughs being positioned in section 306. Ground feed-through 308 is configured to connect with ground feed point 262 (FIG. 2A), and may be connected directly to ground plane 304 by a conductor (not shown) between the feed-through and the ground plane. Alternatively, a ground matching circuit (not shown) may connect ground feed-through 308 and ground plane 304. Live feed-through 310 is configured to connect with live feed point 242. A live feed-pad 312 for antenna 300 may be connected directly to feed-through 310 by a conductor, or alternatively a live matching circuit may connect the feed-pad and the feed-through. For clarity and simplicity, the conductor and the matching circuit for feed-through 310 are omitted from FIG. 9.

The operation of antenna 300 is generally similar to that of antenna 210, element 215 acting as a coupling element to ground plane 304. In addition, the low frequency bands at which antenna 300 operates may be varied by varying one or more dimensions of ground plane 304, typically by varying a length L of the ground plane.

In some embodiments of the present invention, antenna 210 and/or antenna 300 is used as part of a wireless modem. The modem may be configured to couple to a USB (universal serial bus) port, such as the USB port of a laptop computer, so that the computer may receive and transmit efficiently in the bands to which the antenna is tuned. Even with the presence of PCB 302, antenna 300 typically occupies an extremely small volume of approximately 1 $cm^3$.

Figure 10A:
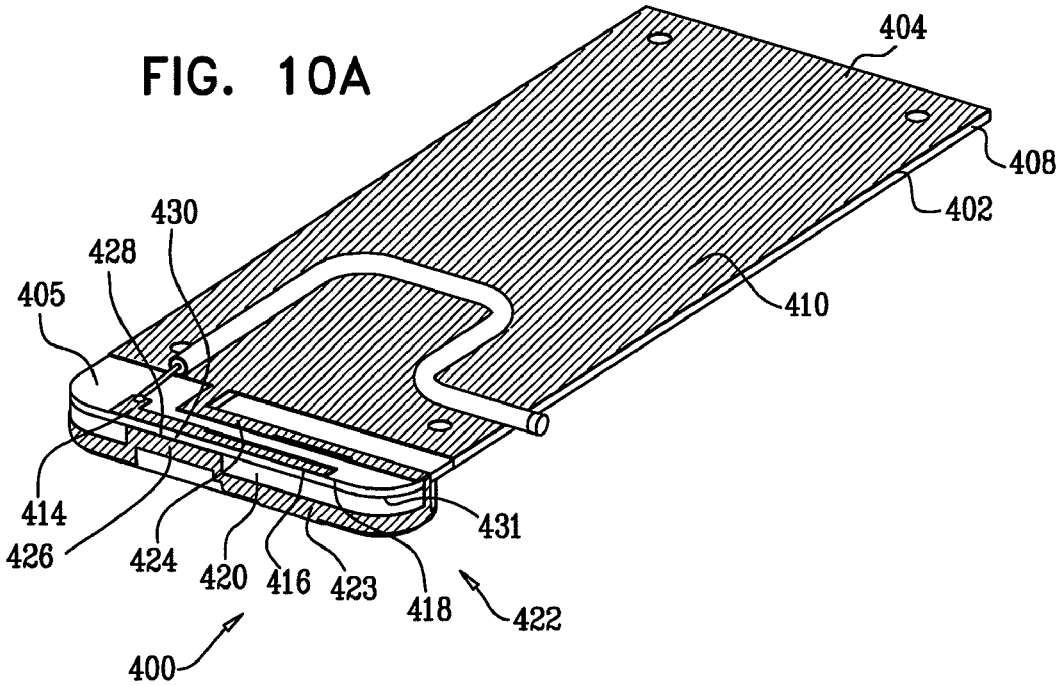
FIGS. 10A and 10B are schematic perspective drawings of a yet further alternative antenna, according to an embodiment of the present invention.
Figure 10B:
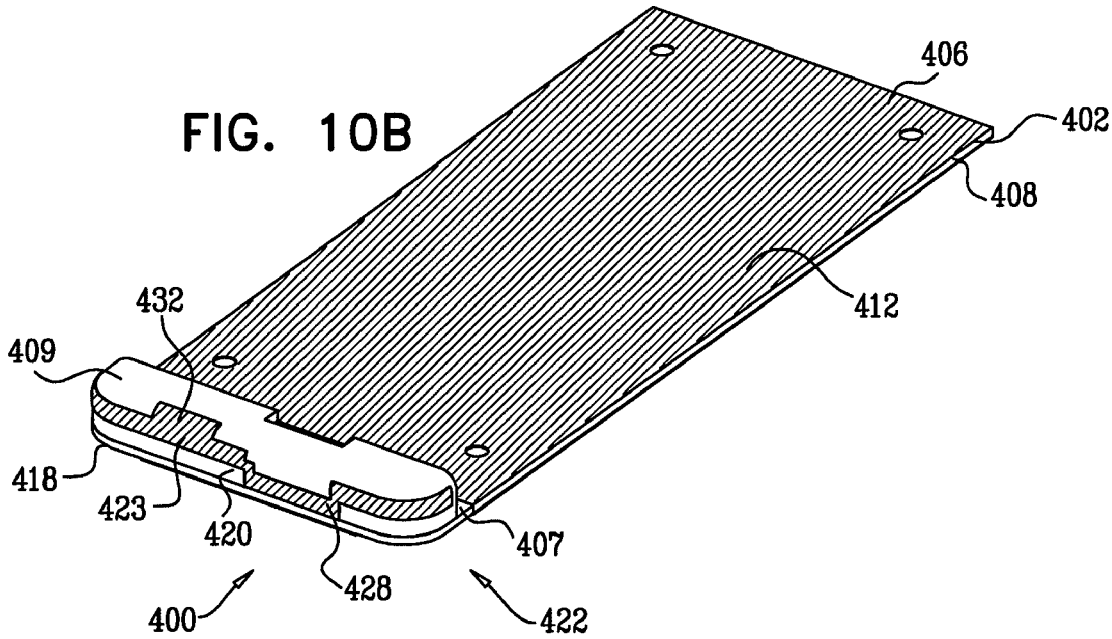

FIGS. 10A and 10B are schematic perspective drawings of an antenna 400, according to an embodiment of the present invention. Antenna 400 operates as an efficient radiator at generally the same frequencies as antennas 30, 210 and 300. Antenna 400 is formed on a printed circuit board (PCB) 402, that has dimensions approximately equal to 100 mm long×40 mm wide. PCB 402 is approximately 1 mm in depth. FIG. 10A shows an upper surface 404 of the PCB, and FIG. 10B shows a lower surface 406 of the PCB.

PCB 402 comprises a dielectric substrate 408, which is covered by conducting material. As described in more detail below, some of the conducting material may be removed to leave conducting elements, so that substrate 408 acts as a dielectric holder for the elements.

A ground plane 410 is formed on an upper surface 405 of substrate 408. Ground plane 410 is typically galvanically connecting by vias with a ground plane 412 formed on a lower surface 407 of the substrate.

A conductive radiator 414 is also formed on upper surface 405. The radiator is configured as a quarter-wave antenna for high frequencies, and is in the form of an inverted-L monopole that is galvanically insulated from ground plane 410. Typically, radiator 414 is formed by removing some conductive material that covers surface 405. Radiator 414 is formed to have a bounding edge 416 of the radiator close to, or common with, an edge 418 of surface 205. Radiator 414 acts as a series resonant circuit, operating and resonating typically at the high frequency bands described above for antennas 30, 210 and 300.

A conductive coupling element 422 has a first section 424 and a second section 426. Section 424 is galvanically connected to ground plane 410. As is shown in the figures, the two sections are galvanically connected by other conductive elements 423 that are formed on a dielectric element 420. Dielectric element 420 is attached, typically by cementing, to lower surface 407, and is typically flush with edge 418. Element 420 typically has a height of approximately 5 mm.

First section 424 is formed on surface 405, typically by removal of conducting material from the surface, and is configured to have parts that are generally parallel to radiator 414. Section 424 is galvanically insulated from the radiator.

Second section 426 is formed on dielectric element 420, and has an edge 428 that is configured to be parallel and very close to edge 418. Typically a gap 430 between edge 428 and bounding edge 416 is of the order of 0.1 mm. Because of the proximity of their edges, there is enhanced capacitance between section 426 and radiator 414, and the value of the enhanced capacitance may be changed by changing the length of section 426 and/or changing the width of gap 430. The enhanced capacitance augments the coupling between element 422 and radiator 414.

As is evident from FIGS. 10A and 10B, element 422 effectively folds around radiator 414. Because element 422 has a three-dimensional character, the folding occurs in three dimensions, and element 422 effectively encompasses a dielectric carrier 431 formed of dielectric element 420 and the portion of substrate 408 connected to the element.

In some embodiments, a conducting third section 432 is galvanically connected to the other conductive elements 423 of coupling element 422 that are on element 420. Element 432 may be formed on an under-surface 409 of element 420. Alternatively or additionally, the third section may be formed on surface 407, beneath element 420. The third section forms a parallel plate capacitor with radiator 414, and further increases the capacitance between the coupling element and the radiator.

In operation, coupling element 422 corresponds to coupling element 60 of antenna 30, typically acting as a series resonant circuit for similar low frequencies as those described with respect to antenna 30, and as a parallel resonant circuit for the high frequencies. As for antenna 30, the coupling element of antenna 400 transfers the low frequencies at which it is in series resonance to ground plane 410. Ground plane 410 typically acts as a parallel circuit resonant at approximately the same series resonant frequencies as coupling element 422, and radiates these frequencies. In addition, as described above for antenna 30, coupling element 422 may be configured to transfer the high frequencies from radiator 414 to the ground plane, which is also able to radiate these frequencies.

Figure 11:
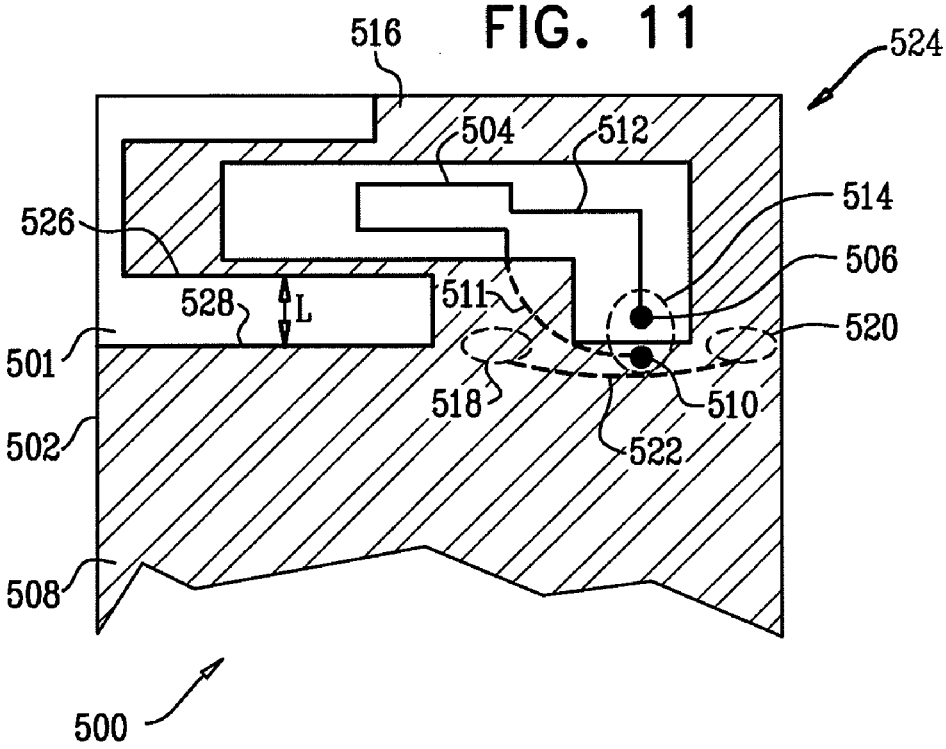
FIG. 11 is a schematic diagram of another antenna, according to an embodiment of the present invention.

FIG. 11 is a schematic diagram of an antenna 500, according to an embodiment of the present invention. By way of example, antenna 500 is assumed to be formed on one plane surface 501 of a dielectric substrate 503 of a PCB 502, so that antenna 500 is substantially two-dimensional. However, those having ordinary skill in the art will be able to adapt the following description, mutatis mutandis, so as to implement three-dimensional antennas similar to antenna 500, as well as to implement antennas formed partially on a plane surface or formed at least partially on a non-plane surface.

Typically, antenna 500 is formed by removal of conducting material that is initially on surface 501. Antenna 500 comprises a full-wave loop 504, the loop having dimensions so that it acts as a series resonant circuit, resonant in a high frequency band such as the 5.6 GHz band. Hereinbelow loop 504 is also termed resonator loop 504. By way of example, resonator loop 504 comprises rectilinear conducting portions 512 that are galvanically connected to each other and that are orthogonal or parallel to each other. However, loop 504 may be formed of any other convenient conducting portions, such as curved conductors.

Resonator loop 504 has a first end 506 that is separated from a ground plane 508, and a second end that comprises a region 510 of the ground plane. A broken line schematically indicates a portion 511 of ground plane 508 that acts to close loop 504. End 506 of the loop is used as a first, live, feed point. Region 510 of ground plane 508, in proximity to end 506, is used as a second, ground, connection, so that a feed region 514 of the antenna consists of end 506 and region 510.

Antenna 500 also comprises a conductive coupling element 516. Coupling element 516 is an approximately half-wave loop which has a first end region 518 and a second end region 520, both ends being regions of ground plane 508. Coupling element 516 is, by way of example, formed from rectilinear portions that are generally parallel to the portions of loop 504. As for loop 504, there is no requirement that element 516 is formed of rectilinear portions. Typically, the direction of the portions of element 516 are configured to be parallel to the portions of loop 504.

Coupling element 516 is closed by a portion 522 of ground plane 508 between regions 518 and 520. Element 516 and portion 522 act as a closed loop 524, hereinbelow also termed coupling loop 524.

Closed coupling loop 524, i.e., coupling element 516 and ground plane portion 522, is configured so that resonator loop 504 is completely surrounded by the coupling loop, as measured in surface 501. Thus, antenna 500 may be considered to be a "loop-within-a-loop" antenna. Coupling loop 524 is typically configured to act as a series circuit resonant at frequencies lower than the resonant frequencies of resonator loop 504, and as a parallel circuit resonant at the resonant frequencies of loop 504. In one embodiment coupling loop 524 is series resonant in the 2.4 GHz band.

Coupling loop 524 couples and transfers frequencies input at feed region 514 to ground plane 508, which acts as a parallel circuit, resonant at approximately the low frequencies referred to above. The coupling between the coupling loop and the ground plane may be adjusted to augment the transfer of frequencies from loop 524 by varying a capacitance between the coupling loop and the ground plane. The inventors have found that a simple but effective way of adjusting the capacitance is by altering a distance L between an edge 526 of element 516 and an edge 528 of the ground plane. If the coupling is adjusted to be relatively high, both low and high frequencies are efficiently transferred from feed region 514 to ground plane 508, which radiates both categories of frequencies.

In one embodiment of antenna 500, which operates as a wide bandwidth antenna in both the 2.4 GHz and 5.6 GHz bands, PCB 502 has a width approximately equal to 50 mm, and edge 528 is approximately 14 mm from the top edge of the PCB. Edges 526 and 528 have approximate lengths 25 mm, and distance L is approximately 4 mm.

Figure 12:
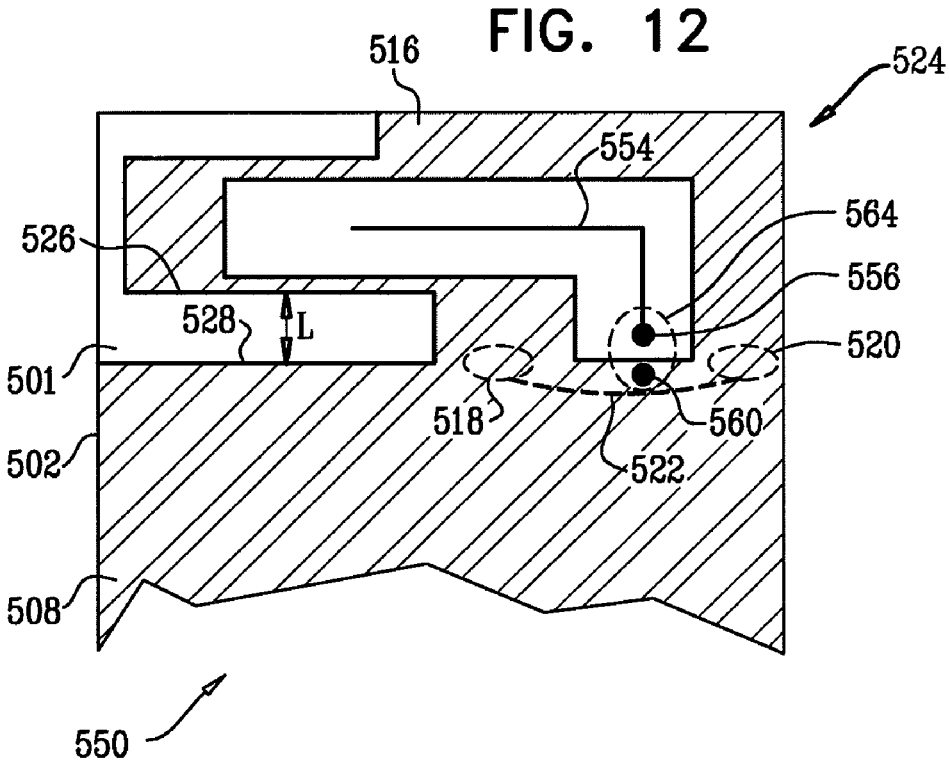
FIG. 12 is a schematic diagram of yet another antenna, according to an embodiment of the present invention.

FIG. 12 is a schematic diagram of an antenna 550, according to an embodiment of the present invention. Apart from the differences described below, the operation of antenna 550 is generally similar to that of antenna 500 (FIG. 11), and elements indicated by the same reference numerals in both antennas 550 and 500 are generally similar in construction and in operation.

In place of full-wave resonator loop 504 of antenna 500, antenna 550 comprises a quarter-wave monopole 554 that acts as a series circuit resonant in a high frequency band such as the 5.6 GHz band. By way of example, monopole 554 comprises one or more rectilinear conducting portions that are galvanically connected to each other and that are orthogonal or parallel to each other. However, monopole 554 may be formed of any other convenient conducting portions, such as curved conductors.

Monopole 554 has an end 556 that is insulated from ground plane 508, and which is used as a first, live, feed point. A region 560 of ground plane 508, in proximity to end 556, is used as a second, ground, connection point, so that a feed region 564 of the antenna consists of end 556 and region 560.

Closed coupling loop 524, comprising coupling element 516 and ground plane portion 522, completely surrounds monopole 554, as measured in surface 501. Thus, antenna 550 may be considered to be a monopole-within-a-loop antenna.

The inventors have found that loop-within-a-loop" antennas such as antenna 500 and monopole-within-a-loop antennas such as antenna 550 radiate high frequencies and low frequencies efficiently, when these frequencies are fed to their respective feed regions 514, 564. As for the antennas described above, the low frequencies, such as frequencies in the 2.4 GHz band described above, are coupled and transferred from loop 504 or monopole 554 via closed coupling loop 524 to ground plane 508. By setting the coupling of the coupling loop to the ground plane to be relatively high, as described above with reference to FIG. 11, the high frequencies also couple and transfer to ground plane 508. The high and low frequencies may thus efficiently radiate from the ground plane.

It will be understood that elements of the embodiments described above may be incorporated to form other embodiments of the present invention. As a first example, an antenna may be implemented that is generally similar to antenna 30, but which incorporates a closed coupling loop and/or a full-wave resonator loop such as are described above for antennas 500 and 550. As a second example, the enhanced capacitance between the monopole and the coupling element, described above with respect to antennas 220 and 300, may be incorporated into an antenna generally similar to antenna 30. In this case the resulting antenna has enhanced capacitance between the coupling element and the monopole, as well as enhanced capacitance (formed in antenna 30 by a coupling capacitor and/or a portion of the coupling element close to the ground plane) between the coupling element and the ground plane.

It will also be understood that embodiments of the present invention may be used to form multiple antennas that are operative for the same circuitry. For example, referring back to FIGS. 1A, 1B, and 1C, a second antenna similar to antenna 30 may be formed at an opposite end of PCB 32, so that circuitry coupled to the PCB is able to use two antennas. Such multiple antennas may be advantageously used as a main antenna and a diversity antenna, so as to improve a signal to noise ratio, and/or in multiple-input-multiple-output (MIMO) applications.

Figure 13:
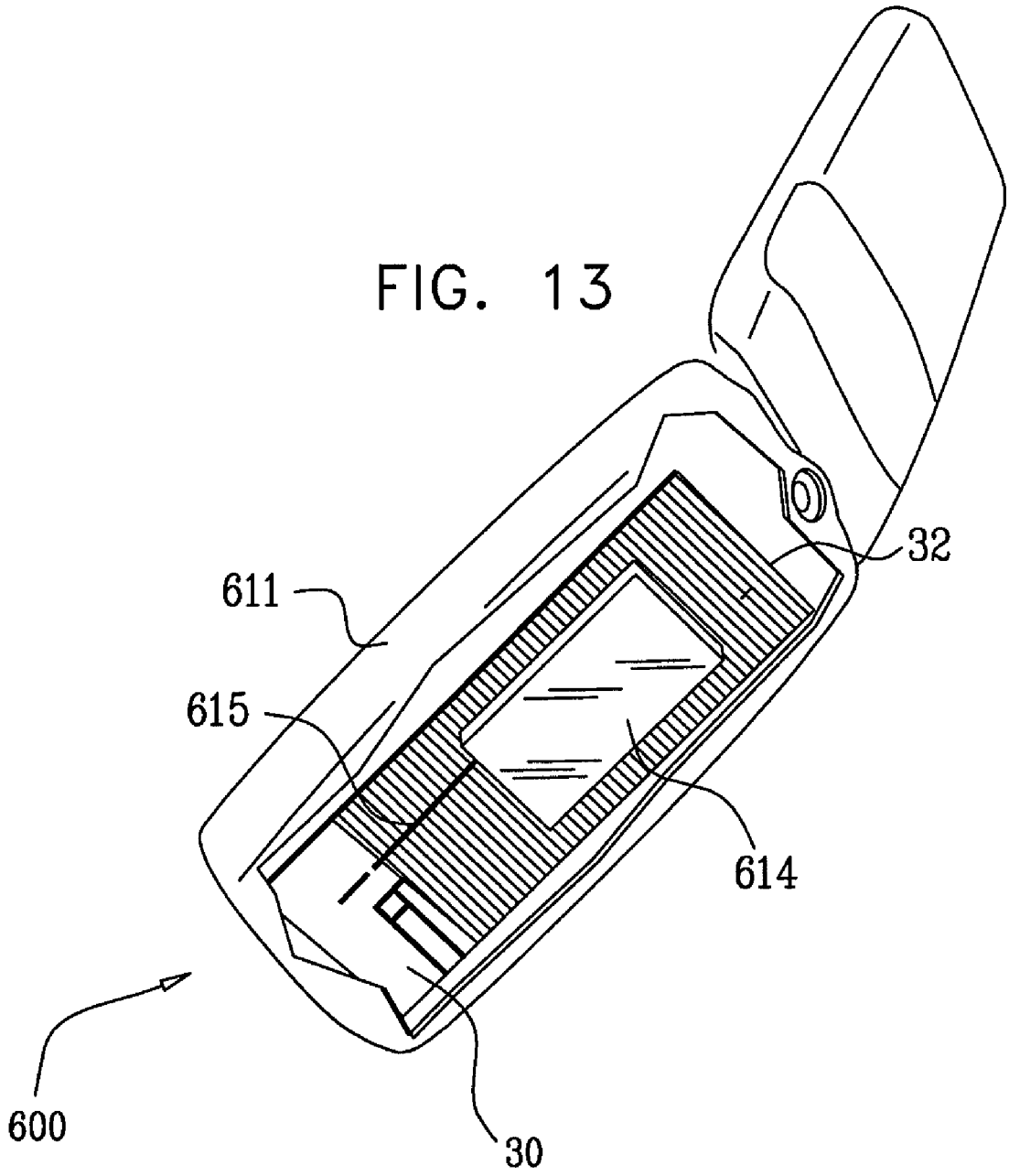
FIG. 13 is a schematic diagram of a communication device, according to an embodiment of the present invention.

FIG. 13 is a schematic diagram of a communication device 600, according to an embodiment of the present invention. Device 600 is typically a cellular phone or a personal digital assistant (PDA), and the device is hereinbelow assumed to comprise a cellular phone. Phone 600 has an enclosure 611, within which operational elements of the phone are mounted, the operational elements including a transceiver 614.

By way of example, antenna 30 (FIGS. 1A, 1B, and 1C), is assumed to be coupled to transceiver 614 by a feed 615. Also by way of example, transceiver 614 is assumed to be mounted on PCB 32, described above with reference to antenna 30. However, it will be understood that any other of the antennas described hereinbove may replace antenna 30, and be coupled to transceiver 614 by feed 615. Feed 615 may be any convenient system that efficiently transfers radio-frequency currents between the transceiver and the antenna, and is herein by way of example assumed to comprise a coaxial cable.

It will be appreciated that the embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

We claim:

1. An antenna, comprising:

a dielectric carrier having a bounding surface;

a conductive monopole resonant at a first frequency, comprising at least one conducting section mounted on the bounding surface; and a labyrinthine conductive coupling element mounted on the bounding surface so as to encompass the dielectric carrier, the coupling element being located with respect to the conductive monopole so as to transfer from the conductive monopole a second frequency lower than the first frequency.

2. The antenna according to claim 1, wherein the conductive monopole comprises a further section mounted within the dielectric carrier.

3. The antenna according to claim 2, wherein the coupling element surrounds the further section.

4. The antenna according to claim 1, wherein the coupling element is resonant at the second frequency.

5. The antenna according to claim 1, and comprising a ground which is located in proximity to the coupling element so as to receive the second frequency transferred from the coupling element.

6. The antenna according to claim 5, and comprising an impedance coupled between the coupling element and the ground so as to enhance transfer of at least one of the first frequency and the second frequency.

7. The antenna according to claim 1, wherein the first frequency comprises a plurality of frequency bands, and wherein the conductive monopole comprises a multi-band monopole configured as a series circuit resonant at the plurality of frequency bands.

8. The antenna according to claim 7, wherein the plurality of frequency bands comprises frequencies between 1700 MHz and 5.6 GHz.

9. The antenna according to claim 1, wherein the second frequency comprises a plurality of frequency bands, and wherein the coupling element is configured as a series circuit resonant at the plurality of frequency bands.

10. The antenna according to claim 9, wherein the plurality of frequency bands comprises frequencies between 700 MHz and 1000 MHz.

11. The antenna according to claim 9, wherein the first frequency comprises a multiplicity of frequency bands, and wherein the coupling element is configured as a parallel circuit resonant at the multiplicity of frequency bands.

12. The antenna according to claim 11, wherein the multiplicity of frequency bands comprises frequencies between 1700 MHz and 5.6 GHz.

13. The antenna according to claim 1, and comprising a capacitance coupled between the coupling element and the monopole so as to enhance the transfer of the second frequency.

14. The antenna according to claim 1, wherein the dielectric carrier comprises a dielectric element connected to a dielectric substrate of a printed circuit board (PCB) at a common surface thereof, and wherein a further section of the conductive monopole is mounted on the common surface.

15. The antenna according to claim 1, wherein the dielectric carrier comprises a dielectric element connected to a dielectric substrate of a printed circuit board (PCB), and wherein the at least one conducting section and the PCB have a common edge.

16. The antenna according to claim 1, wherein the conductive monopole comprises at least one of a linear conductive strip, an L-shaped conductive strip, a folded conductive strip, a meandering conductive strip, and an at least partially looped conductive strip.

17. The antenna according to claim 1, and comprising a ground plane galvanically connected to the coupling element so that a combination of the ground plane and the coupling element form a closed loop.

18. The antenna according to claim 1, wherein the conductive coupling element comprises at least one slot.

19. The antenna according to claim 18, wherein a perimeter of the at least one slot is configured in response to a desired resonant frequency of the conductive element.

20. An antenna, comprising:

a dielectric substrate;

a full-wave loop mounted on the substrate, the full-wave loop being resonant at a first frequency;

a ground plane mounted in proximity to the full-wave loop; and a conductive coupling element galvanically connected to the ground plane so as to form a closed loop completely surrounding the full-wave loop, the conductive coupling element being resonant at a second frequency lower than the first frequency.

21. The antenna according to claim 20, wherein the conductive coupling element transfers the second frequency from the full-wave loop to the ground plane.

22. The antenna according to claim 20, wherein a portion of the conductive coupling element is configured to form a capacitor, with the ground plane, that augments transfer of the first frequency from the full-wave loop to the ground plane.

23. The antenna according to claim 22, wherein the capacitor is external to the closed loop.

24. The antenna according to claim 20, wherein the full-wave loop and the closed loop are mounted on a common plane of the substrate, and wherein the closed loop completely surrounds the full-wave loop as measured in the common plane.

25. An antenna, comprising:

a dielectric substrate;

a monopole mounted on the substrate, the monopole being resonant at a first frequency;

a ground plane mounted in proximity to the monopole; and a conductive coupling element galvanically connected to the ground plane so as to form a closed loop completely surrounding the monopole, the conductive coupling element being resonant at a second frequency lower than the first frequency.

26. The antenna according to claim 25, wherein the conductive coupling element transfers the second frequency from the monopole to the ground plane.

27. The antenna according to claim 25, wherein a portion of the conductive coupling element is configured to form a capacitor, with the ground plane, that augments transfer of the first frequency from the monopole to the ground plane.

28. The antenna according to claim 27, wherein the capacitor is external to the closed loop.

29. The antenna according to claim 25, wherein the monopole and the closed loop are mounted on a common plane of the substrate, and wherein the closed loop completely surrounds the monopole as measured in the common plane.

30. A method for forming an antenna, comprising:

providing a dielectric substrate;

mounting a full-wave loop on the substrate, the full-wave loop being resonant at a first frequency;

positioning a ground plane in proximity to the full-wave loop; and galvanically connecting a conductive coupling element to the ground plane so as to form a closed loop completely surrounding the full-wave loop, the conductive coupling element being resonant at a second frequency lower than the first frequency.

31. A method for forming an antenna, comprising:

providing a dielectric substrate;

mounting a monopole on the substrate, the monopole being resonant at a first frequency;

locating a ground plane in proximity to the monopole; and galvanically connecting a conductive coupling element to the ground plane so as to form a closed loop completely surrounding the monopole, the conductive coupling element being resonant at a second frequency lower than the first frequency.

32. A communication device, comprising:

a transceiver; and an antenna coupled to the transceiver, the antenna comprising:

a dielectric carrier having a bounding surface;

a conductive monopole resonant at a first frequency, comprising at least one conducting section mounted on the bounding surface; and a labyrinthine conductive coupling element mounted on the bounding surface so as to encompass the dielectric carrier, the coupling element being located with respect to the conductive monopole so as to transfer from the conductive monopole a second frequency lower than the first frequency.

33. A method for producing a communication device, comprising:

providing a transceiver; and coupling an antenna to the transceiver, the antenna comprising:

a dielectric carrier having a bounding surface;

a conductive monopole resonant at a first frequency, comprising at least one conducting section mounted on the bounding surface; and a labyrinthine conductive coupling element mounted on the bounding surface so as to encompass the dielectric carrier, the coupling element being located with respect to the conductive monopole so as to transfer from the conductive monopole a second frequency lower than the first frequency.

34. A method of forming an antenna, comprising:

providing a dielectric carrier having a bounding surface;

mounting at least one conducting section of a conductive monopole resonant at a first frequency on the bounding surface; and mounting a labyrinthine conductive coupling element on the bounding surface so as to encompass the dielectric carrier, the coupling element being located with respect to the conductive monopole so as to transfer from the conductive monopole a second frequency lower than the first frequency.

* * * * *